US012011751B2

(12) United States Patent
Kutschar et al.

(10) Patent No.: US 12,011,751 B2
(45) Date of Patent: Jun. 18, 2024

(54) RELIABLE HANDLING OF SLEEVES OR METAL COILS OF SMALL EXTERNAL DIAMETER ON A COILER MANDREL

(71) Applicant: Primetals Technologies Austria GmbH, Linz (AT)

(72) Inventors: Wolfgang Kutschar, St. Georgen an der Gusen (AT); Gernot Dirisamer, Grieskirchen (AT); Franz Schallauer, Bad Hall (AT)

(73) Assignee: Primetals Technologies Austria GmbH, Linz (AT)

( * ) Notice: Subject to any disclaimer, the term of this patent is extended or adjusted under 35 U.S.C. 154(b) by 0 days.

(21) Appl. No.: 18/284,140

(22) PCT Filed: Mar. 22, 2022

(86) PCT No.: PCT/EP2022/057424
§ 371 (c)(1),
(2) Date: Sep. 26, 2023

(87) PCT Pub. No.: WO2022/207401
PCT Pub. Date: Oct. 6, 2022

(65) Prior Publication Data

US 2024/0149320 A1 May 9, 2024

(30) Foreign Application Priority Data

Mar. 31, 2021 (EP) ..... 21166357

(51) Int. Cl.
*B65H 19/12* (2006.01)
*B21C 47/24* (2006.01)

(52) U.S. Cl.
CPC ..... *B21C 47/24* (2013.01); *B65H 19/12* (2013.01); *B65H 2301/4175* (2013.01)

(58) Field of Classification Search
CPC .. B21C 47/24; B65H 19/12; B65H 2301/4175
See application file for complete search history.

(56) References Cited

U.S. PATENT DOCUMENTS 4,934,511 A * 6/1990 Wood, III ..... B65G 25/02 198/464.2
5,248,109 A * 9/1993 Berger ..... B21C 47/24 242/559.3

(Continued)

FOREIGN PATENT DOCUMENTS

EP 2644290 A1 10/2013
JP S4843409 B1 12/1973

OTHER PUBLICATIONS

European Search Report received in European Application No. 21166357.0 dated Sep. 28, 2021, 9 pages.

(Continued)

*Primary Examiner* — Sang K Kim
(74) *Attorney, Agent, or Firm* — Liang & Hennessey LLP; Brian Hennessey

(57) ABSTRACT

The invention relates to a coil-transporting carriage with adjustable retaining arms and to a method for the reliable handling of metal coils of small external diameter, or of sleeves, on a coiler mandrel. The coil-transporting carriage has a vertically displaceable coil saddle for accommodating a coil or a sleeve, also has two retaining arms for stabilizing the coil or the sleeve, the retaining arms being arranged opposite one another on the coil saddle and being pivotable by means of rotary drives, and additionally has a second drive unit for moving the coil-transporting carriage. For pulling off from a coiler mandrel, the coil saddle is positioned against a coil located on the coiler mandrel and the retaining arms are pivoted onto the coil. For pushing onto a coiler mandrel, first a sleeve is placed on the coil saddle of (Continued)

the coil-transporting carriage and is thereby guided by the retaining arms.

14 Claims, 8 Drawing Sheets

(56) References Cited

U.S. PATENT DOCUMENTS

| | | | | |
|---|---|---|---|---|
| 5,956,990 | A * | 9/1999 | Ginzburg | B21C 47/245<br>242/527.5 |
| 6,311,823 | B1 * | 11/2001 | Bierbaum | B65G 47/34<br>198/360 |
| 7,229,045 | B2 * | 6/2007 | Bucher | B65H 19/12<br>242/561 |
| 8,555,476 | B2 * | 10/2013 | Cramer | F16M 11/00<br>242/363 |
| 9,289,809 | B2 * | 3/2016 | Cramer | B21C 47/24 |
| 9,744,577 | B2 * | 8/2017 | Hofmann | B21C 47/24 |
| 11,273,480 | B2 * | 3/2022 | Hofer | B21C 47/24 |

OTHER PUBLICATIONS

International Search Report and Written Opinion received in International Application No. PCT/EP2022/057424 dated Sep. 22, 2022, 18 pages.

* cited by examiner

RELIABLE HANDLING OF SLEEVES OR METAL COILS OF SMALL EXTERNAL DIAMETER ON A COILER MANDREL

CROSS-REFERENCE TO RELATED APPLICATIONS

The present application is a national phase application of PCT Application No. PCT/EP2022/057424, filed Mar. 22, 2022, entitled "RELIABLE HANDLING OF SLEEVES OR METAL COILS OF SMALL EXTERNAL DIAMETER ON A COILER MANDREL", which claims the benefit of European Patent Application No. 21166357.0, filed Mar. 31, 2021, each of which is incorporated by reference in its entirety.

BACKGROUND OF THE INVENTION

1. Field of the Invention

The invention relates to a coil-transporting carriage with adjustable retaining arms and a method for the reliable handling of metal coils of small external diameter or of sleeves on a coiler mandrel.

2. Description of the Related Art

Horizontally displaceable coil-transporting carriages with a vertically displaceable coil saddle are known from the prior art. A plurality of bearing rollers, which in each case are rotatable axially about a horizontal direction, can be arranged on the upper face of the coil saddle for receiving a coil. Such coil-transporting carriages are suitable for the reliable handling (for example the transport from an initial position to a target position, pushing onto or pulling off from a coiler mandrel, etc.) of such coils which have a sufficient dead weight that they do not tend to spring open without further shearing procedures being carried out.

Depending on production specifications, however, metal strips to be wound off from a coiler mandrel are sometimes not wound off fully (for example in the case of a reversible coiler) but a residual piece of the relevant metal strip remains on the coiler mandrel and has to be transported away thereby. Such residual pieces, when their external diameter does not exceed a specific value do, for example 750 mm, are also denoted as so-called "residual coils" and generally also have a correspondingly low dead weight. The value do is also denoted as the "limit diameter".

For transporting such a residual piece away from a coiler mandrel, after uncoiling a large part of the original strip which is still connected to the residual piece, the coil saddle of a coil-transporting carriage is adjusted against the lower face of the residual piece. Subsequently, a cutting step takes place, the uncoiled strip part being cut off thereby from the residual piece remaining on the coiler mandrel. The residual piece remaining on the coiler mandrel is then wound back thereby (i.e. rotated counter to the unwinding direction) sufficiently far that the free strip end on the peripheral side comes to rest in the vicinity of the coil saddle (so-called 5 o'clock or 7 o'clock position).

If the external diameter of the residual piece is below the maximum limit diameter $d_0$, such a residual coil can be mechanically unstable—in particular in the case of a high inherent strength of the strip material—and can tend to spring open due to the residual elastic tension present in the metal strip, which naturally represents a high risk to safety during the transport and handling thereof. Various solutions for transporting unstable coils are known from the prior art.

Thus for pulling off high-strength coils from a coiler mandrel by means of a coil-delivery carriage, EP 2 648 860 B1 proposes to stabilize one respective coil by means of two retaining arms, wherein the retaining arms in each case exert a retaining force on the external peripheral surface or in the coil eye of the coil. Such a solution requires a high degree of structural complexity and only has a limited transport range since the retaining arms in each case are designed as separately displaceable facilities and have to be synchronized with the movements of the coil-delivery carriage.

A coil-transporting carriage with a clamping facility is disclosed in EP 3 366 381 A1, the clamping facility being able to be lowered in the coil saddle and in the activated state, by exerting a retaining force in the coil eye of a metal coil deposited on the coil-transporting carriage, being able to press this metal coil against the coil saddle and thus stabilize it in terms of its position. In principle, a rotation of a coil on such a coil-transporting carriage is possible even when the clamping facility is activated but it is not possible to transfer a coil still fully located on a coiler mandrel directly onto the coil-transporting carriage when the clamping facility is extended at the same time, since this would collide with the coiler mandrel.

EP 2 544 835 B1 discloses the monitoring of a high-strength coil as to whether it is located in an unstable equilibrium position after being deposited on two fixed bearing points, and in this case to place a further movable bearing point below the central plane of the metal coil against the outer peripheral surface thereof. Since the coil is held only below its central plane and thus is not held over more than half of its external periphery, there is no positive connection with the bearing points so that even for a deposited coil which is already stabilized, automatic opening due to a high residual tension, for example triggered by a high level of vibrations or thermal shrinkage of the coil itself, cannot be ruled out with certainty.

There is also occasionally the need to wind coils with a greater internal diameter than an existing coiler mandrel might permit. To this end, a so-called "sleeve" is pushed onto the relevant coiler mandrel before the coiling process as such. Since sleeves have only a low dead weight, similar to residual coils, during the handling thereof by means of a coil-transporting carriage there is the risk of the sleeves falling down or rolling down to the side, which is why the sleeves according to the prior art are pushed onto a coiler mandrel by means of a dedicated facility in the form of a sleeve manipulator.

None of the solutions proposed in the documents EP 2 648 860 B1, EP 3 366 381 A1 and EP 2 544 835 B1, however, can be used both for the mechanical stabilization of a residual coil after the cutting step has been carried out, when already wound back onto the coiler mandrel, and for pushing a sleeve onto a coiler mandrel.

SUMMARY OF THE INVENTION

Thus it is the object of the present invention to develop a coil-transporting carriage which is known from the prior art such that a reliable handling of coils is made possible thereby, in particular of coils of an external diameter which is smaller than a limit diameter $d_0$, and of sleeves on a coiler mandrel.

A coil-transporting carriage according to the invention for the reliable handling of coils, in particular of coils of an external diameter which is smaller than a limit diameter $d_0$, or sleeves on a coiler mandrel, has a coil saddle which is vertically displaceable by means of a first drive unit. A plurality of bearing rollers are arranged on the upper face of the coil saddle for receiving a coil or a sleeve, wherein the bearing rollers are in each case axially rotatable about a first horizontal direction $X_1$. Preferably, the first horizontal direction $X_1$ coincides with the longitudinal axis of the coiler mandrel.

The coil-transporting carriage also has retaining arms for stabilizing the coil, in the event that the external diameter thereof is not greater than a limit diameter $d_0$, or the sleeve. The retaining arms are arranged in pairs in a second horizontal direction $X_2$ opposing one another on the coil saddle, wherein the second horizontal direction $X_2$ is oriented perpendicularly to the first horizontal direction $X_1$. The retaining arms are pivotable about the first horizontal direction $X_1$ by means of rotary drives and thus can be pivoted onto a coil or sleeve located on the coil saddle and thus prevent the coil undesirably springing open or the coil or the sleeve rolling down to the side. Preferably, the coil-transporting carriage has two or four retaining arms. If the external diameter of the coil exceeds a maximum limit diameter $d_0$, the retaining arms are not required.

The coil-transporting carriage according to the invention also has a second drive unit, the coil-transporting carriage being able to be displaced horizontally thereby. As a result, the coil-transporting carriage can be moved toward the coiler mandrel and moved away from the coiler mandrel, for example in order to pull off a coil from the coiler mandrel or to push a sleeve onto the coiler mandrel. Preferably, the horizontal direction in which the coil-transporting carriage can be moved by means of the second drive unit coincides with the first horizontal direction $X_1$ in the region of the coiler mandrel or in the receiving region for a sleeve.

The coil-transporting carriage according to the invention also has a control unit for actuating the first and second drive unit and the rotary drives and a data interface for communication with a higher-level control unit. The data interface enables the control unit of the coil-transporting carriage to receive data, relating to a transport process to be carried out, from the higher-level control unit which, for example, can be a system automation.

The data received from the higher-level control unit can be present merely in the form of key data of the upcoming transport process, the data comprising, for example, the state m of the coiler mandrel (collapsed or spread apart), the dimensions a and/or weight g of the coil, a target position Z to which the coil is to be transported or a receiving position A on which a sleeve is to be transferred from the coil-transporting carriage. In this case, the control unit is designed to determine and to implement automatically the chronological sequence and the control signals for the actuation of the first and second drive unit and the rotary drives. The parameters include, for example, the travel paths or the adjusting forces of the individual facilities.

The control unit can also be designed to determine automatically on the basis of the status signal for the coiler mandrel whether a coil can be pulled off from the coiler mandrel or a sleeve can be pushed onto the coiler mandrel. For example, the control unit can automatically identify an impermissible operating state (for example when a coil is intended to be pulled off from the coiler mandrel or a sleeve is intended to be pushed onto the coiler mandrel, but the coiler mandrel is still spread apart) and report this via the data interface to the higher-level control unit and wait for further control commands.

Further sensor signals (for example light barriers for identifying obstacles) can also be supplied to the control unit and this control unit can be designed such that it is able to establish automatically on the basis of these further sensor signals whether a transport process can be carried out without a collision. In turn, the control unit can automatically identify an imminent collision of the coil-transporting carriage or a part thereof with an obstacle as an impermissible operating state and via the data interface report back to the higher-level control unit and interrupt or not start any transport process.

In one embodiment of the coil-transporting carriage according to the invention, the rotary drives are designed as geared motors. Since the retaining arms of the coil-transporting carriage have to perform a rotary movement for fixing a coil or a sleeve, by combining a motor with a rotating output shaft and a corresponding reduction gear advantageously a small design can be achieved for the respective rotary drives, whereby the risk of collisions when handling a coil or a sleeve is minimized.

In a further embodiment of the coil-transporting carriage according to the invention, the retaining arms can be pivoted into a park position P, so that the greatest extent $d_{max}$ between the retaining arms in the second horizontal direction $X_2$ is smaller than or equal to the greatest dimension $d_{btw}$ of the coil-transporting carriage in the second horizontal direction $X_2$. The "greatest extent" $d_{max}$ between the retaining arms in the second horizontal direction $X_2$ is understood to mean the greatest possible distance which is spanned by two points respectively located on one of the two retaining arms in the second horizontal direction $X_2$, when the retaining arms are in the park position P. Equally the "greatest dimension" $d_{btw}$ of the coil-transporting carriage in the second horizontal direction $X_2$ is understood to mean the greatest possible distance which two points respectively located on opposing sides of the coil-transporting carriage span in the second horizontal direction $X_2$.

In simplified terms, the pivoting of the retaining arms into the park position has the result that the retaining arms in the park position P are not "wider" than the coil-transporting carriage itself, when the width direction of the coil-transporting carriage is equated with the second horizontal direction $X_2$. As a result, it is advantageously achieved that when transporting coils which require no stabilization due to their dimensions, the retaining arms can be pivoted into the park position in a space-saving manner and no additional space is required in comparison with coil-transporting carriages known from the prior art. Thus the coil-transporting carriage according to the invention is suitable as a replacement or retrofitted solution for existing transport devices, since no structural changes are required for the corresponding distance traveled.

Preferably, the retaining arms are designed such that coils or sleeves of an external diameter which ranges between 500 mm and a limit diameter do are stabilized in a form-locking manner. The limit diameter do can be, for example, 750 mm. This is achieved by a corresponding shaping of the retaining arms. "Stabilized in a form-locking manner" is understood to mean that each of the retaining arms of the coil-transporting carriage, when correspondingly adjusted by the rotary drives against the coil or sleeve located on the coil saddle, comes into contact with the coil or the sleeve on the peripheral side on at least one point above a horizontal central plane through a longitudinal axis M of the coil or the sleeve.

To avoid scratches or dents on the peripheral surface of the coil or the sleeve during the adjustment process of the retaining arms and during the transport by the coil-transporting carriage, the retaining arms on their inner faces are preferably provided with a friction-reducing coating or slide rollers.

In the method according to the invention for pulling off a coil from a coiler mandrel by means of a coil-transporting carriage, the external diameter of the coil being smaller than a limit diameter $d_0$, according to the invention in a first step S1 the coil saddle of the coil-transporting carriage is displaced vertically by means of the first drive unit and adjusted against the coil located on the coiler mandrel, which at this point in time is still connected to an uncoiled strip portion, so that the bearing rollers of the coil saddle come into contact with the coil on its lower face.

The adjustment of the coil saddle onto the coil located on the coiler mandrel can take place, for example, in a force-controlled or position-controlled manner A position-controlled adjustment can take place either on the basis of the corresponding coil diameter or on the basis of a sensor signal (for example from a distance sensor or touch sensor). A force-controlled adjustment can take place by the assistance of a force measuring device for the coil saddle, on the basis of the corresponding coil weight g or on the basis of a predetermined maximum adjusting force. A combination of force-controlled and position-controlled adjustment is also possible. To this end, the relevant coil diameter or the relevant coil weight g can have been transmitted via the data interface to the control unit of the coil-transporting carriage.

Particularly preferably, the coil saddle is adjusted against the coil located on the coiler mandrel with a force which corresponds to the weight force of the coil after the uncoiled strip portion has been cut off: as a result, the coiler mandrel is relieved of the weight force of the coil so that in a following step this coil can be easily pulled off from the coiler mandrel since, with a collapse of the coiler mandrel required therefor, it is no longer necessary to compensate for elastic distortion—caused by the weight force of the coil or by too great an adjusting force of the coil saddle.

In a second step S2 of the method according to the invention, the retaining arms are pivoted onto the coil by means of the rotary drives. The pivoting of the retaining arms onto the coil can take place, for example, by applying a specific torque so that it is ensured that the retaining arms actually come into contact with the external peripheral surface of the coil. As a result, the free strip end, which in a following third step S3 is produced by cutting off the uncoiled strip portion from the coil, is pushed against the external peripheral surface of the coil and mechanically secured against falling down or springing open in an uncontrolled manner. The uncoiled strip portion is cut off from the coil in the third step S3 by means of a cutting device which is arranged to the side of the coiler mandrel—i.e. in a direction transversely to the longitudinal axis thereof.

In a fourth step S4 of the method according to the invention, the coil is rotated by means of the coiler mandrel counter to an unwinding direction U of the coil until the free strip end of the coil is positioned on the peripheral side within a predetermined angular range $\alpha_{max}$ relative to the vertical through a longitudinal axis M of the coil. The angular range $\alpha_{max}$ can be determined by the geometric arrangement of the bearing rollers of the coil saddle so that the free strip end is positioned, for example, at a maximum of 20 cm from one of the bearing rollers (so-called 5 o'clock or 7 o'clock position). Preferably, when the coil is rotated counter to an unwinding direction U the free strip end is not rotated across one of the bearing rollers, in order to avoid impressions of the strip edge in the layers of the coil located below. The unwinding direction U of the coil is to be understood to mean the rotational direction in which the coil is rotated when unwound from the coiler mandrel. In the spread-apart state of the coiler mandrel, there is no mechanical contact between the coiler mandrel and the coil in the coil eye thereof. Thus subsequently, i.e. after rotation has taken place counter to the unwinding direction U, the previously spread-apart coiler mandrel is collapsed (i.e. the external diameter thereof is reduced so that there is no longer any mechanical contact between the coiler mandrel and the coil).

In a subsequent fifth step S5 of the method according to the invention, the coil-transporting carriage is moved by means of the second drive unit away from the coiler mandrel until the coil is fully pulled off from the coiler mandrel so that no part of the coiler mandrel still protrudes into the coil eye of the coil. At the same time, while moving away the coil-transporting carriage, the coiler mandrel is rotated counter to the unwinding direction U in order to avoid the internal winding of the coil remaining suspended on the coiler mandrel. In a subsequent sixth step S6, by activating the second drive unit the coil is transported by the coil-transporting carriage to a target position, for example a binding station.

According to one embodiment of the method according to the invention, in a step S5' which is carried out between the fifth and the sixth step S5 and S6, the coil saddle is lowered vertically by means of the first drive unit. This increases the mechanical stability of the coil-transporting carriage in the second horizontal direction $X_2$ during the transport process.

According to a further embodiment of the method according to the invention, the control unit of the coil-transporting carriage receives data via the data interface from a higher-level control unit, the control unit actuating the first and second drive unit and the rotary drives on the basis thereof, so that the sequence of the steps S1 to S6 is carried out.

According to one embodiment of the method according to the invention, the data received from the higher-level control unit can be present merely in the form of the above-described key data of the upcoming transport process. The data can comprise the state m of the coiler mandrel, the dimensions a of the coil on the coiler mandrel, a coil weight g or a target position Z to which the coil has to be transported after being pulled off from the coiler mandrel.

In this case, the control unit is designed to determine and implement automatically the chronological sequence and the control signals for the actuation of the first and second drive unit and the rotary drives, so that the sequence of steps S1 to S6 is carried out autonomously by the coil-transporting carriage or the control unit thereof, which is denoted as the so-called fully automatic operating mode of the coil-transporting carriage. Advantageously, the control and monitoring effort for the respective coil transport is minimized on the part of the higher-level control unit.

Alternatively, for the individual sub-steps of the transport process to be carried out, for example for each of the aforementioned steps S1 to S6, the control unit of the coil-transporting carriage can also receive via the data interface corresponding data packets from the higher-level control unit, wherein the control signals for the actuation of the first and second drive unit and the rotary drives are determined by the control unit of the coil-transporting carriage, but the chronological sequence of the individual sub-steps is predetermined by the higher-level control unit. This corresponds to a semi-automatic operating mode of the coil-transporting carriage and provides a greater chronological flexibility relative to the chronological sequence of a transport process.

According to a further alternative, for carrying out the aforementioned sequence of steps S1 to S6, the control unit of the coil-transporting carriage can also receive the control signals for the actuation of the individual facilities, such as for example the first and second drive unit and the rotary drives, directly via the data interface from a higher-level control unit or an operator (for example by actuating corresponding buttons or switches). This corresponds to a manual operating mode (also denoted as jog mode) of the coil-transporting carriage.

In the method according to the invention for pushing a sleeve onto a coiler mandrel by means of a coil-transporting carriage according to the invention, in a first step S11 the coil-transporting carriage is displaced by means of the second drive unit to a receiving position A in front of a delivery station 30 and the coil saddle is displaced by means of the first drive unit into a vertical transfer height $h_0$ in order to transfer the sleeve. The retaining arms are pivoted by means of the rotary drives into a securing position S while the coil-transporting carriage is in a receiving position A. The receiving position A is located relative to the first horizontal direction $X_1$ at the same position as the delivery station so that the center of the coil saddle relative to the direction $X_1$ coincides with the center of the sleeve along its longitudinal axis M.

The transfer height $h_0$ is dependent on the sleeve diameter and on the structural dimensions of the delivery station from which the sleeve is transferred to the coil-transporting carriage. For example, the transfer height $h_0$ can be 500 to 1000 mm below an initial height $h_1$ of the sleeve at the delivery station, wherein the transfer height $h_0$ and the initial height $h_1$ in each case refer to the same reference height (for example a bottom level of the delivery station).

In the securing position S the retaining arms are pivoted into such a position that they are located to a large extent above the bearing rollers of the coil saddle, wherein the inner faces of the retaining arms are spaced sufficiently far apart from one another in the second horizontal direction $X_2$ that the sleeve to be delivered onto the coil-transporting carriage can be lowered between the retaining arms onto the coil saddle without coming into contact with the retaining arms themselves. As a result, the sleeve is prevented from inadvertently falling down or rolling down during the delivery process.

The structural dimensions of the delivery station and the relevant sleeve diameter can have been transmitted via the data interface to the control unit of the coil-transporting carriage, so that the control unit automatically determines therefrom the transfer height $h_0$ of the coil saddle and the securing position S of the retaining arms. Alternatively, the transfer height $h_0$ and the securing position S can also be stored as fixed values in the control unit.

In a second step S12, the sleeve is deposited from the delivery station by means of a delivery device onto the coil saddle of the coil-transporting carriage. For example, the delivery device can be designed as a pivoting device, the sleeve being delivered thereby from the initial height $h_1$ onto the coil saddle which at this time is at the transfer height $h_0$.

In a third step S13, the retaining arms are pivoted by means of the rotary drives onto the sleeve, so that the inner faces of the retaining arms positively come into contact with the sleeve on their outer peripheral side, whereupon in a fourth step S14 the coil-transporting carriage is displaced by means of the second drive unit to a position directly in front of the coiler mandrel and in a fifth step S15 the coil saddle is displaced vertically by means of the first drive unit until a longitudinal axis M of the sleeve is located level with the coiler mandrel.

Subsequently, in a sixth step S16 the coil-transporting carriage is moved by means of the second drive unit toward the collapsed coiler mandrel along the longitudinal axis thereof until the sleeve is pushed fully onto the coiler mandrel but does not yet come into contact therewith, since the internal diameter of the sleeve is greater than the diameter of the coiler mandrel in the collapsed state. Then in a seventh step S17 the coiler mandrel is expanded so that the sleeve is held in a force-locking mannerby the coiler mandrel.

In an eighth step S18, the retaining arms are pivoted away from the sleeve by means of the rotary drives and the coil saddle is lowered vertically by means of the first drive unit. As a result, there is no longer any mechanical contact between the coil saddle and the retaining arms, on the one hand, and the sleeve, on the other hand, so that for example the coil-transporting carriage can be subsequently moved by means of the second drive unit away from the coiler mandrel. As a result, the working space can be released in the region of the coiler mandrel for winding devices assigned thereto (for example so-called basket rollers), so that a metal strip can be wound onto the sleeve.

In one embodiment of the method according to the invention, for pushing a sleeve onto a coiler mandrel, during the second step S12 the coil saddle is displaced by means of the first drive unit in the vertical direction so that the coil-transporting carriage does not collide with any part of the delivery device of the delivery station.

For example, a delivery device in the form of a pivoting device can comprise two support arms which are spaced apart from one another in the first horizontal direction $X_1$ and by which the sleeve during the delivery to the coil-transporting carriage is retained. Since, when the sleeve is deposited onto the coil saddle, parts of the support arms in the vertical direction have to be pivoted below the bearing rollers and can collide with parts of the coil-transporting carriage, for example with the rotary drives for the pivoting arms, in such a case the movement of the coil saddle has to be synchronized with the movement of the pivoting device or the support arms in order to avoid a collision.

According to a further embodiment of the method according to the invention, for pushing a sleeve onto a coiler mandrel the control unit receives data via the data interface from the higher-level control unit, the control unit actuating the first and second drive unit and the rotary drives on the basis thereof, so that the sequence of the steps S11 to S18 is carried out. Similar to the above-described method for pulling off a coil from a coiler mandrel—once again the data can comprise the dimensions a of the sleeve, the state m of the coiler mandrel and/or the receiving position A, in which case the control unit is designed to determine and to implement the chronological sequence and the control signals for the actuation of the first and second drive unit and the rotary drives automatically, so that the sequence of the steps S11 to S18 is carried out autonomously by the coil-transporting carriage or the control unit thereof (fully automatic operating mode). Once again, advantageously the control and monitoring effort for the respective sleeve transport is minimized on the part of the higher-level control unit.

Equally, as already described above, however, a sleeve can also be transported in a semi-automatic or manual operating mode.

BRIEF DESCRIPTION OF THE DRAWINGS

The above-described properties, features and advantages of this invention and the manner in which they are achieved will become clearer and more easily comprehensible in connection with the following description of exemplary embodiments which are explained in more detail in combination with the drawings, in which.

DETAILED DESCRIPTION

Figure 1:
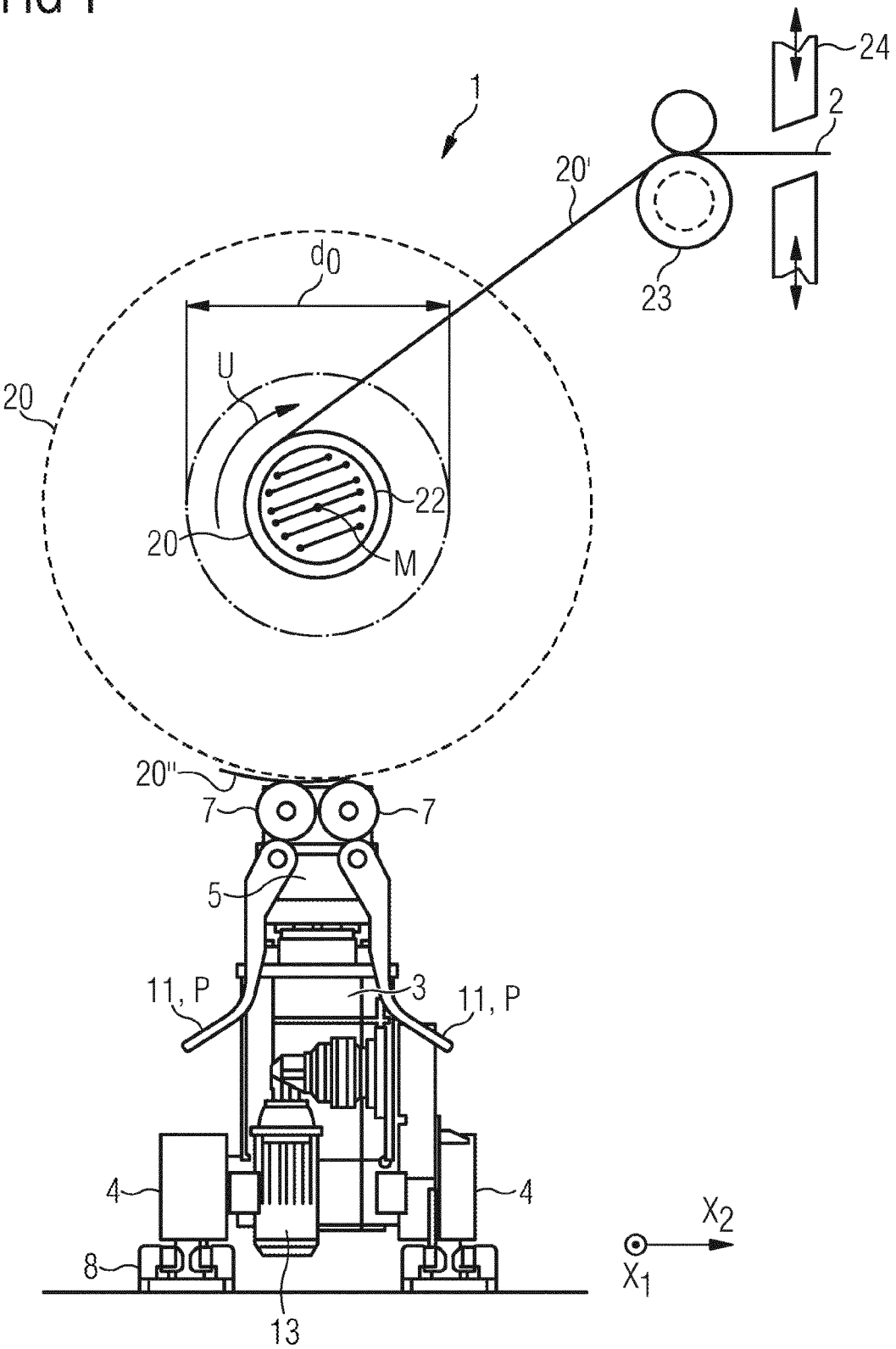
FIGS. 1 and 2 show a first exemplary embodiment of a coil-transporting carriage according to the invention when viewed in a first horizontal direction $X_1$ when transferring a coil or residual coil.

Parts which correspond to one another are provided in the figures with the same reference numerals.

Figure 2:
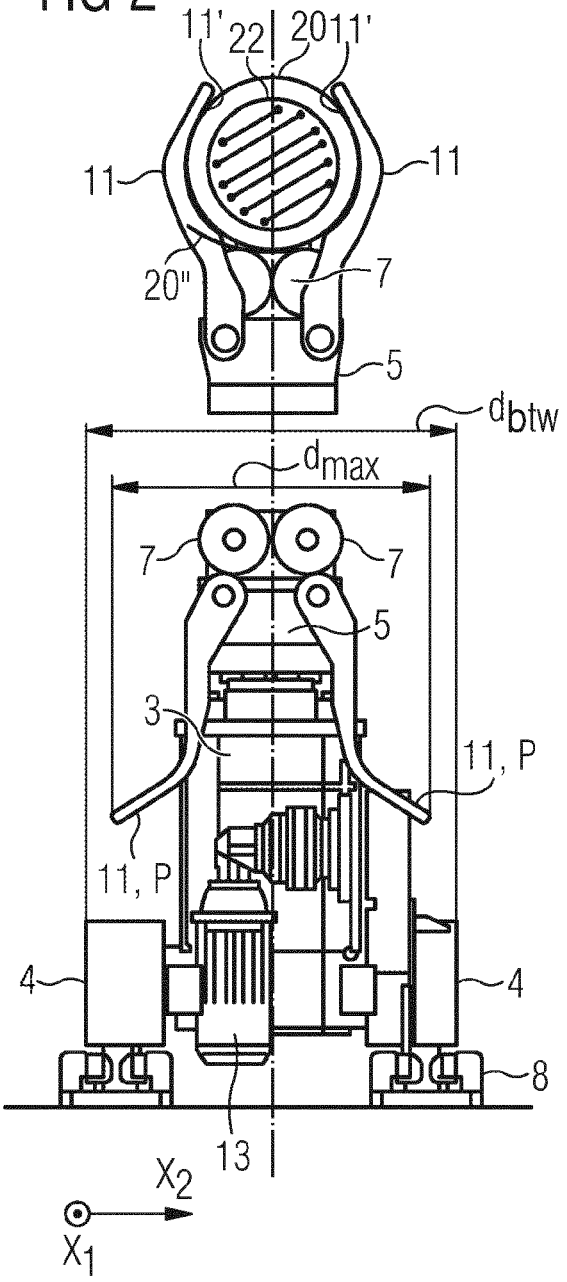

FIG. 1 (FIG. 1) and FIG. 2 (FIG. 2) show a coil-transporting carriage 1 according to the invention in the direction of a first horizontal direction $X_1$ when transferring a coil 20 from a coiler mandrel 22. The longitudinal axis M of the coil 20 coincides with the longitudinal axis M of the coiler mandrel 22 and is oriented in the first horizontal direction $X_1$. The coil-transporting carriage 1 has a coil saddle 5 which can be displaced by means of a first drive unit 3 in the vertical direction. The first drive unit 3 can be designed, for example, as a hydraulic cylinder. Four bearing rollers 7, which are axially rotatable about the first horizontal direction $X_1$, are arranged in pairs on the upper face of the coil saddle 5 in each case in the first horizontal direction $X_1$, respectively two bearing rollers thereof being visible in FIGS. 1, 2 and 2A. The coil-transporting carriage 1 also has a chassis 4 and a second drive unit 13 arranged thereon, the coil-transporting carriage 1 being able to be displaced thereby in the first horizontal direction $X_1$ on rails 8.

Figure 2A:
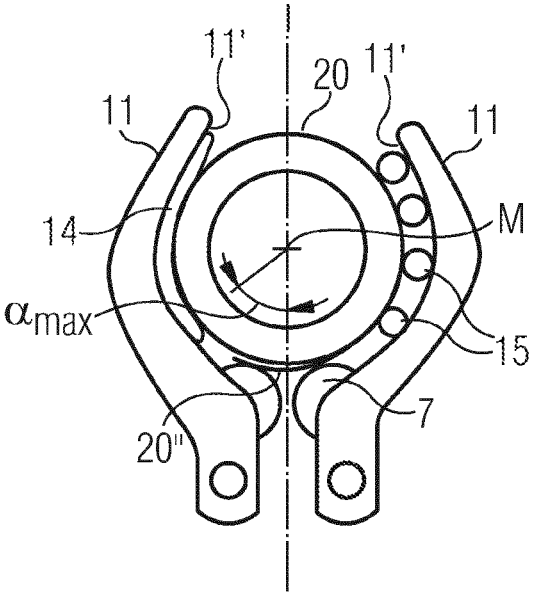
FIG. 2A shows a detail of FIG. 2 with the residual coil.

The coil-transporting carriage 1 also has four retaining arms 11 for stabilizing a residual coil 20 or a sleeve 21, respectively two arms thereof being visible in FIG. 1, 2 or 2A. The retaining arms 11 are arranged in pairs in a second horizontal direction $X_2$ opposing one another on the coil saddle 5, wherein the second horizontal direction $X_2$ is oriented perpendicularly to the first horizontal direction $X_1$. The retaining arms are designed to be pivotable about the first horizontal direction $X_1$ by means of rotary drives 9 (shown in FIG. 3).

In FIG. 1 a residual coil 20 is shown, the external diameter thereof being smaller than a limit diameter do and which is still connected via a strip portion 20' to an already unwound portion of the metal strip 2. The unwinding direction U when unwinding the metal strip 2 from the residual coil 20 runs clockwise, wherein the strip portion 20' which does not bear against the residual coil 20 is held by a pair of drive rollers 23. When viewed in the unwinding direction U a cutting device 24 is arranged downstream of the pair of drive rollers 23, the metal strip 2 being able to be cut off thereby from the residual coil 20 remaining on the coiler mandrel 22.

FIG. 1 also shows the coil saddle 5 in a lower vertical position and also schematically—additionally to the residual coil 20 for the purpose of illustrating the size ratios—a coil 20 shown in dashed dotted lines, the external diameter thereof being greater than a limit diameter do shown in dashed lines, and the free strip end 20" thereof being positioned in a 7 o'clock position in the vicinity of the bearing rollers 7 of the coil saddle 5. Since such a coil 20 does not have to be stabilized due to its dead weight, the retaining arms 11 of the coil-transporting carriage 1 in FIG. 1 are pivoted into a park position P.

In FIG. 2 the coil saddle 5 of the coil-transporting carriage 1 is shown both in the lower vertical position thereof as in FIG. 1 and schematically in a raised vertical position, in which the retaining arms 11 are adjusted onto a residual coil 20 on the coiler mandrel 22, so that the retaining arms 11 with their respective inner faces 11' come into contact with the residual coil 20 on the peripheral side. Once again, the free strip end 20" of the residual coil 20 is also positioned in FIG. 2 in a 7 o'clock position in the vicinity of the bearing rollers 7 of the coil saddle 5. It can also be seen in FIG. 2 that in the second horizontal direction $X_2$ the greatest extent d max between the retaining arms 11, which are located in the park position P, is smaller than the greatest dimension $d_{btw}$ of the coil-transporting carriage 1 which extends in the view of FIGS. 1 and 2 along the chassis 4.

FIG. 2A (FIG. 2A) shows a detailed enlargement of FIG. 2, a residual coil 20 being positioned on the bearing rollers 7 of the coil saddle 5 (not shown in FIG. 2A) and the retaining arms 11 being adjusted against the residual coil 20. The free strip end 20" of the residual coil 20 is positioned below the longitudinal axis M of the residual coil 20 and in the vicinity of the left-hand bearing roller 7 within a predetermined angular range $\alpha_{max}$ relative to the vertical, through the longitudinal axis M of the residual coil 20, so that the dead weight thereof advantageously counteracts the springing-open of the residual coil 20. A friction-reducing coating 14 is applied to the inner face 11' of the left-hand retaining arm 11, and slide rollers 15 are attached to the inner face of the right-hand retaining arm 11.

Figure 3:
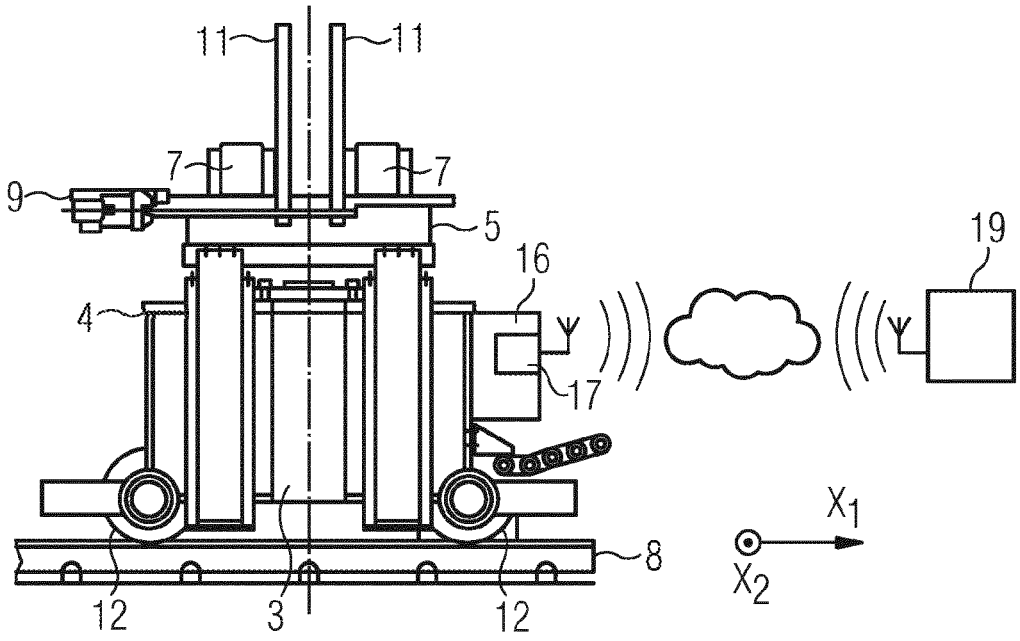
FIG. 3 shows the exemplary embodiment of the coil-transporting carriage of FIGS. 1 and 2 in a second horizontal direction $X_2$.

FIG. 3 (FIG. 3) shows the exemplary embodiment of the coil-transporting carriage 1 according to the invention in the unloaded state in a second horizontal direction $X_2$, wherein in FIG. 3 two of the four bearing rollers 7 or two of the four retaining arms 11 can be seen. The retaining arms 11 are arranged in the first horizontal direction $X_1$ between the bearing rollers 7 on the coil saddle 5. In a modification of the exemplary embodiment, the coil-transporting carriage 1 can also have more than four bearing rollers 7, for example six or eight bearing rollers 7, or a different number of retaining arms 11, for example two or six retaining arms 11. Each two of the retaining arms 11 are driven by a rotary drive 9 and can be pivoted thereby about the first horizontal direction $X_1$. The chassis 4 of the coil-transporting carriage 1 is mounted via wheels 12 on the rails 8.

A data interface 17 which is connected to a control unit 16 of the coil-transporting carriage 1 enables the control unit 16 to exchange data with a higher-level control unit 19. According to a first exemplary embodiment of the coil-transporting carriage according to the invention, the communication path to the higher-level control unit 19 is designed as a wireless radio link, for example in the form of a WLAN connection or a data laser connection. Alternatively, however, a wired transmission path between the data interface 17 and the higher-level control unit 19 is also possible, for example in the form of a trailing cable or as a signal modulated to a power supply of the coil-transporting carriage 1.

Figure 4:
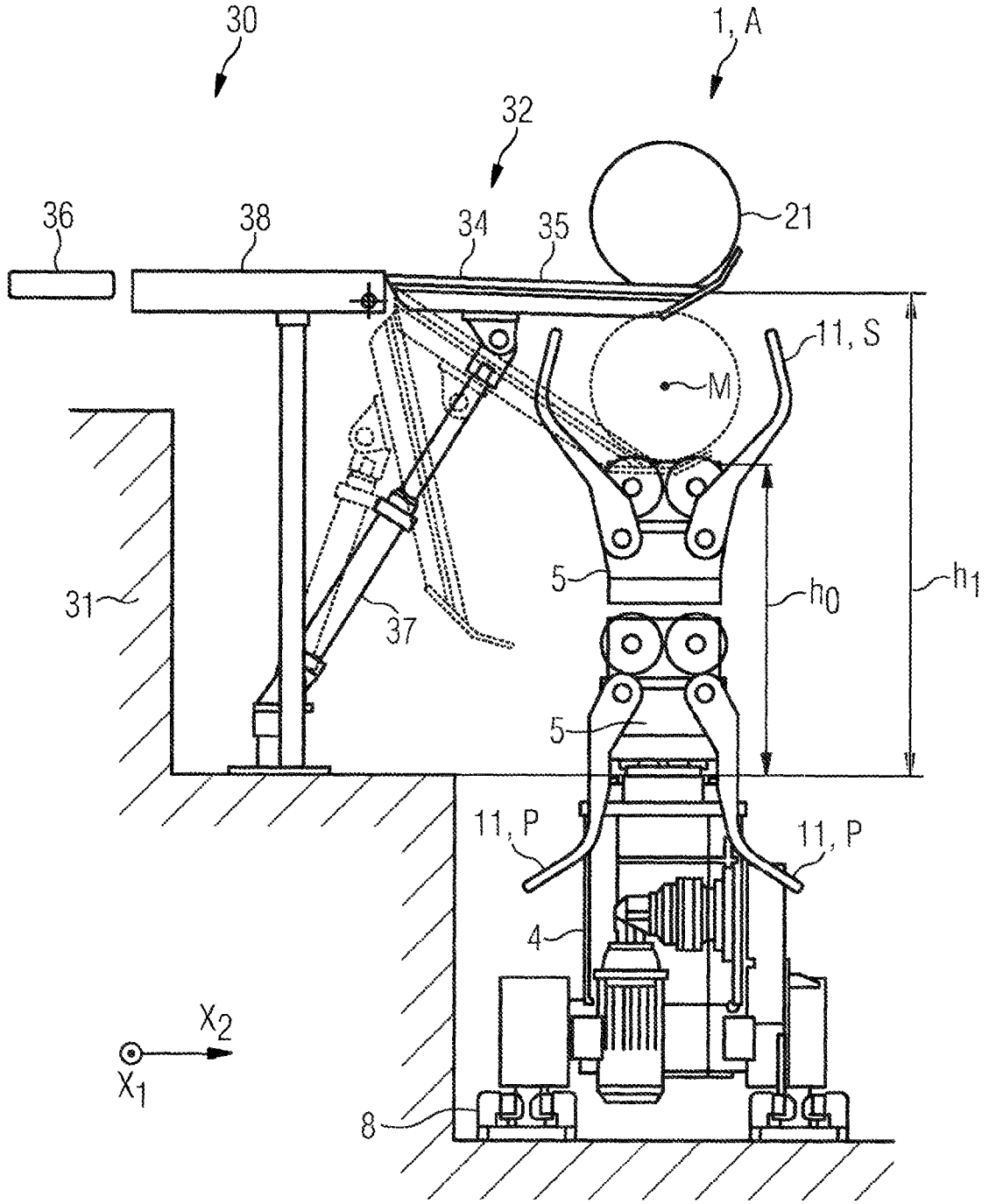
FIG. 4 shows a coil-transporting carriage according to the invention when viewed in the first horizontal direction $X_1$ in a delivery position A for transferring a sleeve.

In FIG. 4 (FIG. 4) the coil-transporting carriage 1 according to the invention is shown in a receiving position A in front of a delivery station 30 during the transfer of a sleeve 21. The delivery station 30 comprises a multistage base 31, a roller conveyor 36 for onward transportation of a sleeve 21 and a movable pivoting device 32 for delivering a sleeve 21 to the coil-transporting carriage 1. Via a fixed longitudinal member 38, which is supported on a first step of the base 31, a sleeve 21 can be transferred from the roller conveyor 26 to the pivoting device 32. The pivoting device 32 comprises two support arms 34 with upwardly bent runners connected via a crossmember 35. The support arms 34 can be lowered with the sleeve 21 located thereon by means of a pivoting drive 37 which, as shown for example in FIG. 4, can be designed as a rotatably mounted hydraulic cylinder and at its upper end is connected to the crossmember 35.

For illustrating the process of delivering the sleeve 21 to the coil-transporting carriage 1, in FIG. 4 the pivoting device 32 is shown in three pivoting positions, wherein the sleeve 21 in the uppermost pivoting position is positioned at an initial height $h_1$ on the support arms 34 of the pivoting device 32.

Equally the coil saddle 5 of the coil-transporting carriage 1 is shown in a lower vertical position in which the retaining arms 11 are in the park position P, and in a vertical position located thereabove at the transfer height $h_0$ at which the delivery takes place by a displacement of the weight of the sleeve 21 from the pivoting device 32 to the coil saddle 5. During the delivery, the retaining arms 11 are pivoted into a securing position S in order to secure the sleeve 21 against falling out to the side in the direction of the second horizontal direction $X_2$, when the pivoting device 32 is lowered. The initial height $h_1$ and the transfer height $h_0$ refer in each case to the first step of the base 31. If required, the lowering of the pivoting device 32 and the coil saddle 5 can take place in a coordinated manner with the delivery of the sleeve 21, so that a collision is avoided between the parts of the pivoting device 32 and the parts of the coil-transporting carriage 1.

Figure 5:
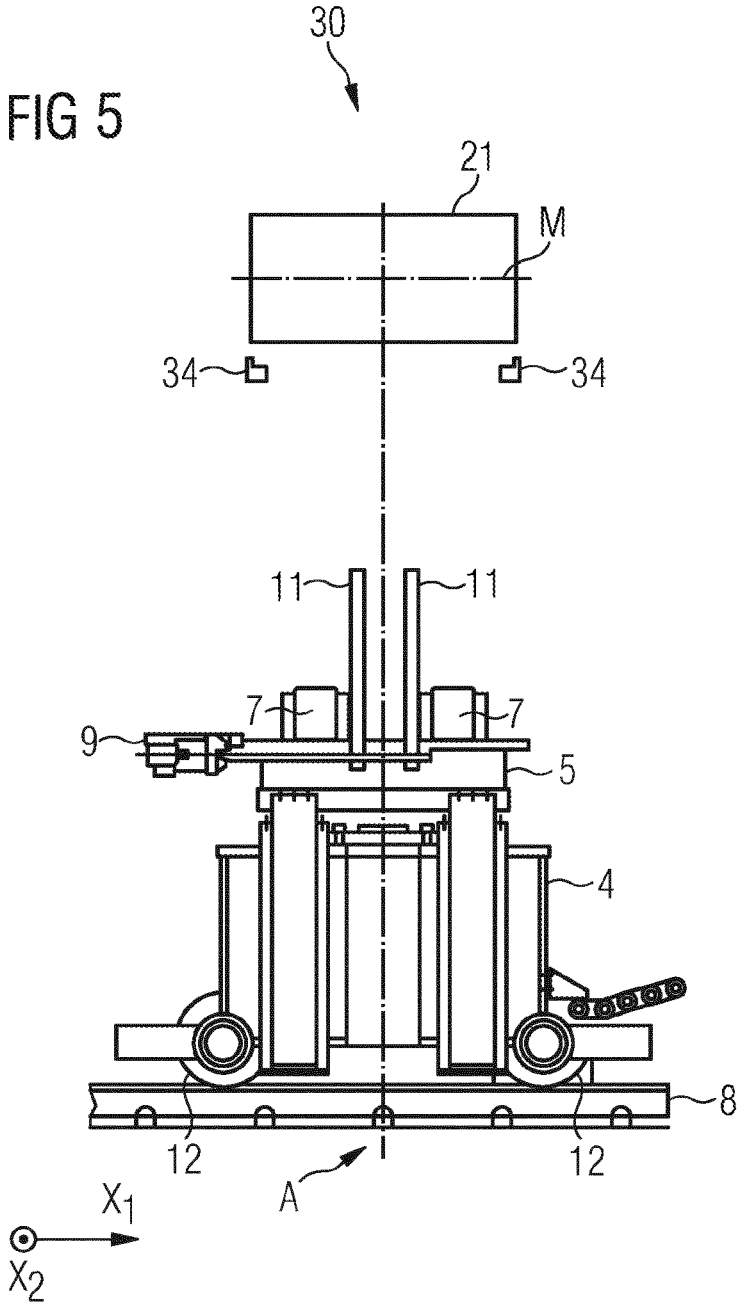
FIG. 5 shows the coil-transporting carriage according to the invention of FIG. 4 when viewed in the second horizontal direction $X_2$.

FIG. 5 (FIG. 5) coincides in essential parts with FIG. 3, wherein additionally the receiving position A of the coil-transporting carriage 1 is shown in front of the delivery station 30 and a sleeve 21 and the support arms 34 are shown schematically in the uppermost pivoted position of the pivoting device 32.

Figure 6:
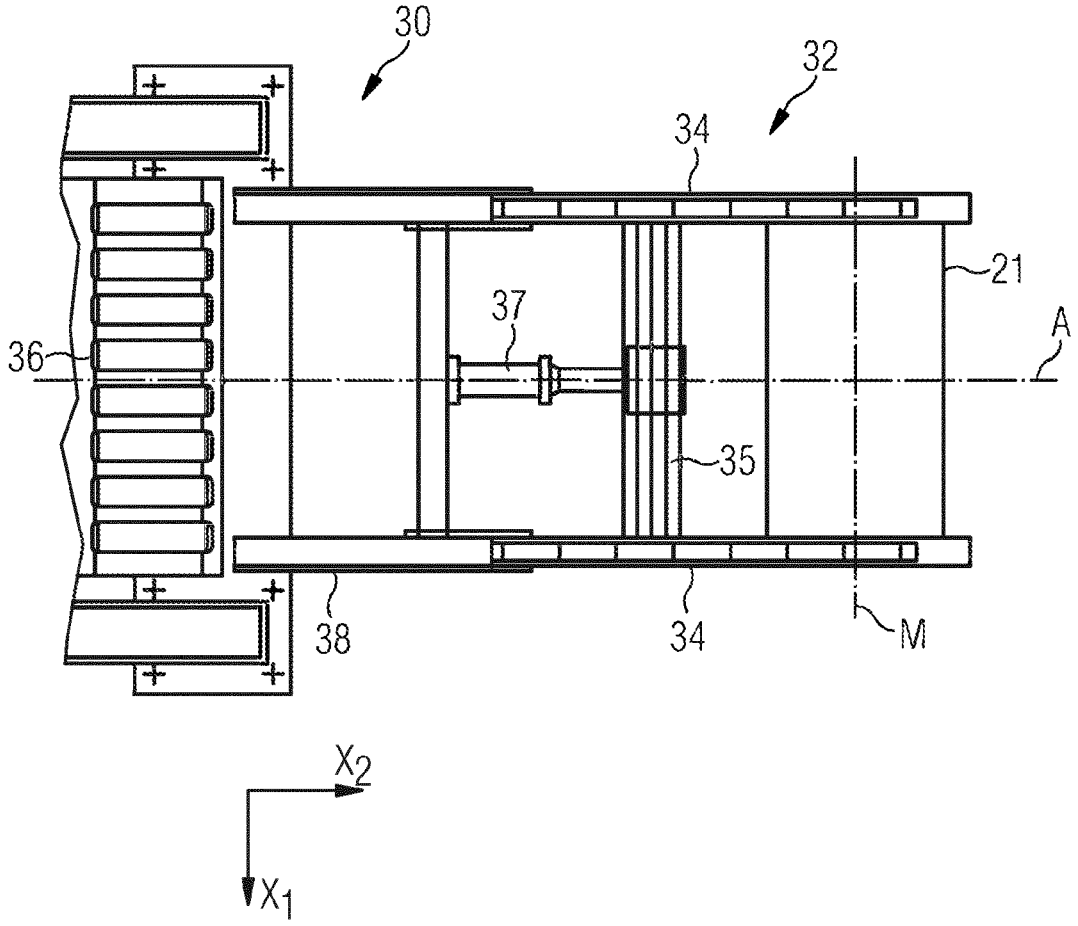
FIG. 6 shows a delivery station for a sleeve.

FIG. 6 (FIG. 6) shows in a plan view in a vertical direction the delivery station 30 with the roller conveyor 36, the pivoting device 32 with the support arms 34, the crossmember 35 and the pivoting drive 37 and a sleeve 21 which is secured by the runners of the pivoting arms 34 against rolling down in the second horizontal direction $X_2$. The receiving position A for the coil-transporting carriage 1 which is located in the first horizontal direction $X_1$ centrally between the support arms 34 is also shown.

Figure 7:
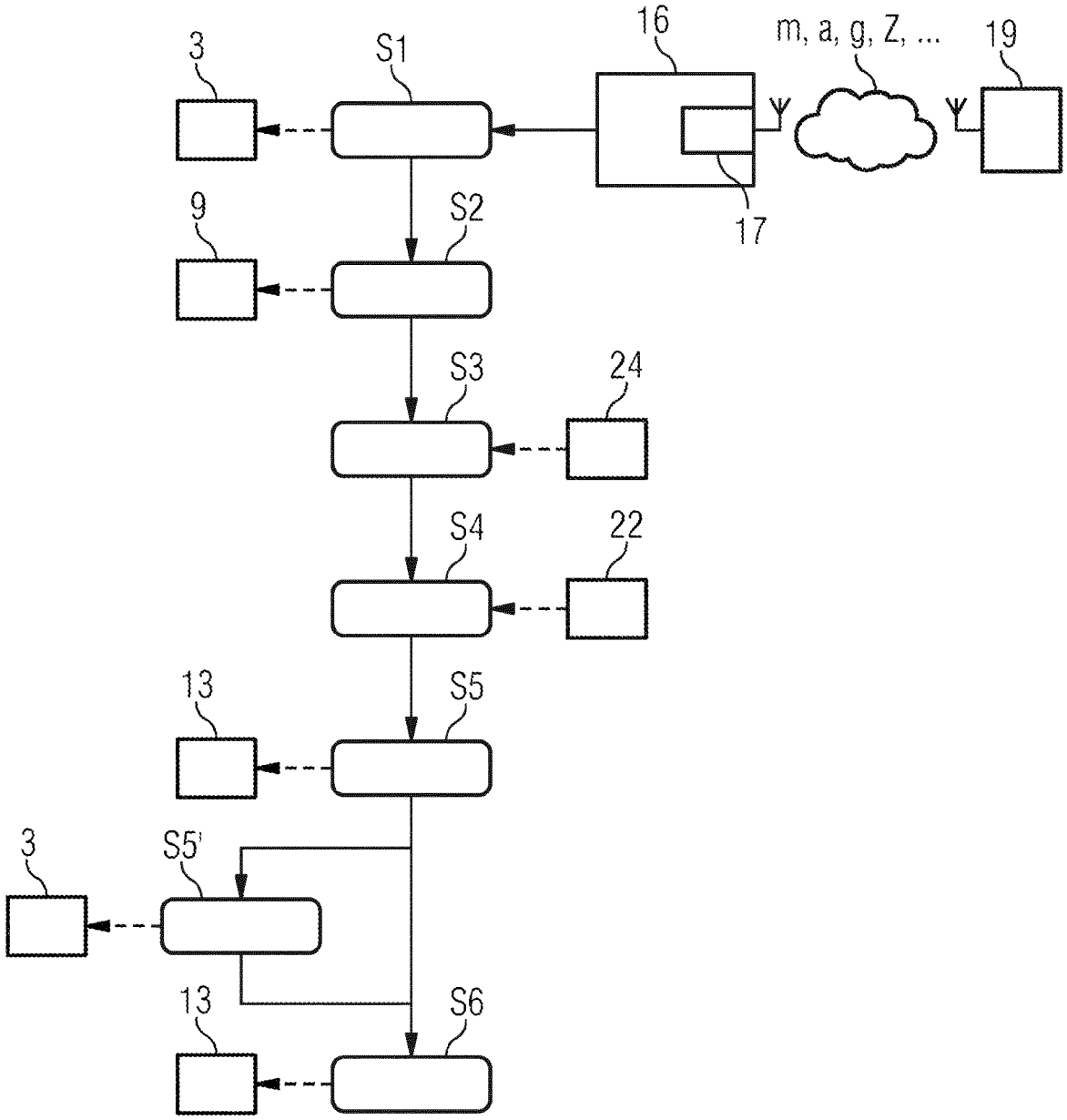
FIG. 7 shows a sequence of a method according to the invention for pulling off a coil from a coiler mandrel.

In FIG. 7 (FIG. 7) a method according to the invention for pulling off a coil 20 from a coiler mandrel 22 by means of a coil-transporting carriage 1 according to the invention is shown schematically in the form of a sequence consisting of the above-described steps S1 to S6. Via the interface 17 and via a wireless connecting path to a higher-level control unit 19, the key data of a coil transportation to be carried out are initially transmitted therefrom to the control unit 16 of the coil-transporting carriage 1. The key data comprise at least the state m of the coiler mandrel 22, the dimensions of the coil 20 (external diameter, dimension along its longitudinal axis M, etc.), the coil weight g and a target position Z to which the coil 20 is to be transported by the coil-transporting carriage 1. The control unit 16 is designed to carry out the sequence automatically, by the corresponding facilities of the coil-transporting carriage—as described above the first and second drive unit 3 and 13 for displacing the coil saddle 5 or the coil-transporting carriage 1 and the rotary drives 9 for setting the retaining arms 11—being activated by the control unit 16 in the steps S1, S2, S5, S5' and S6. These activations are shown in FIG. 7 in each case by dashed arrows from the corresponding steps to the aforementioned facilities.

In the third and fourth step S3 or S4, the cutting step carried out by a cutting device 24 or the rotation of the coil 20 by the coiler mandrel 22 counter to the unwinding direction U and the subsequent collapse of the coiler mandrel 22, which in FIG. 7 is symbolized by dashed arrows from the respective facilities to the relevant steps, is reported to the control unit 16. This reporting can be carried out, for example, by corresponding confirmation signals, in turn via the external control unit 19 and the interface 17. In other words: the control unit 16 waits for confirmation of the implementation of the aforementioned processes by the external facilities before it carries out the further steps of the sequence.

Figure 8:
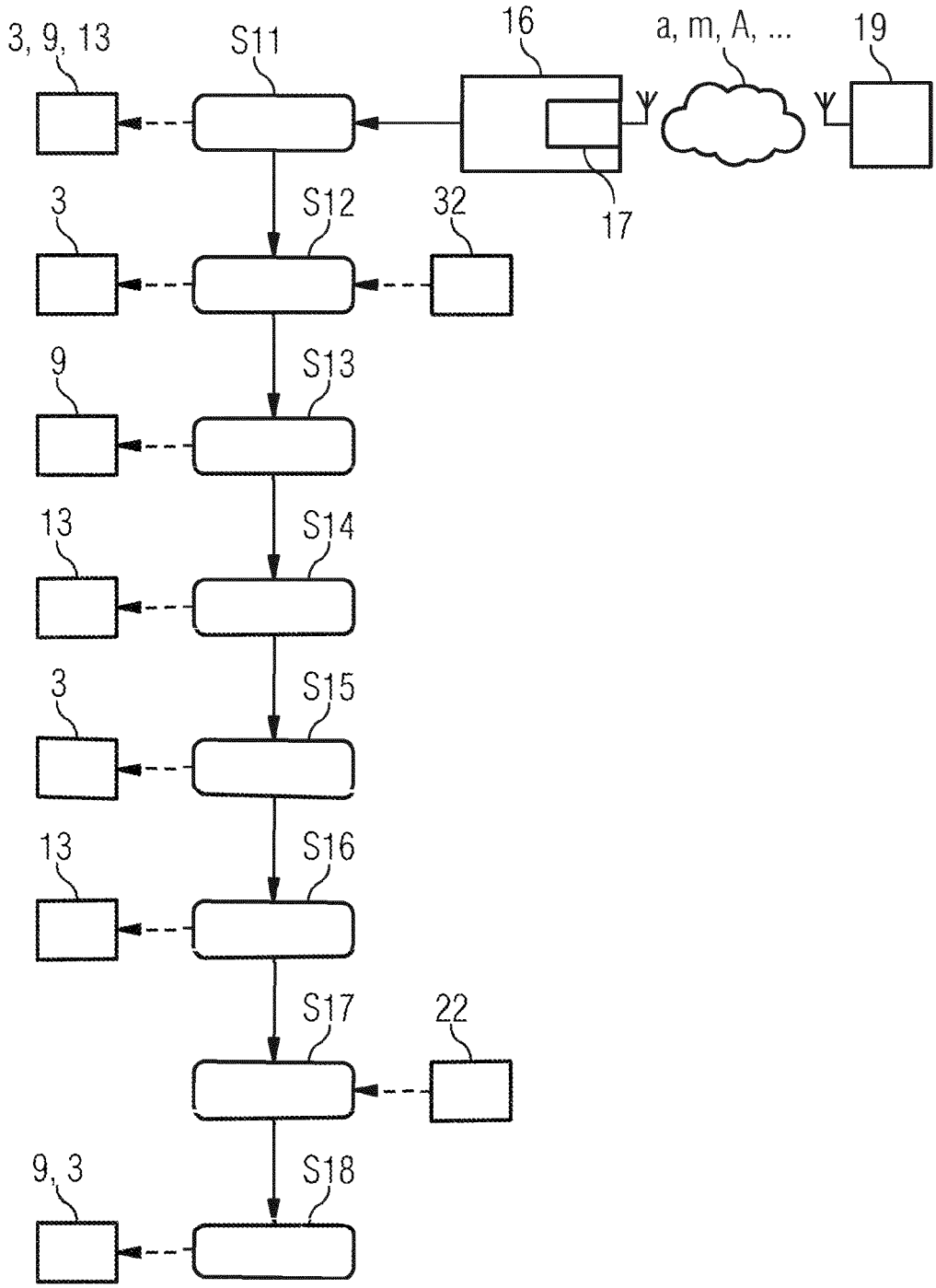
FIG. 8 shows a sequence of a method according to the invention for pushing a sleeve onto a coiler mandrel.

Similar to FIG. 7 (FIG. 7), in FIG. 8 (FIG. 8) a sequence of a method according to the invention for pushing a sleeve 21 onto a coiler mandrel 22 is shown schematically in the form of a sequence consisting of the above-described steps S11 to S18. Once again, via the interface 17 and via a wireless connection path to a higher-level control unit 19, the key data of a sleeve transportation to be carried out are initially transmitted therefrom to the control unit 16 of the coil-transporting carriage 1. The key data comprise at least the dimensions of the sleeve 21 (external diameter, dimension along its longitudinal axis M, etc.), the state m of the coiler mandrel 22 and a receiving position A of a delivery station 30 from which the sleeve 21 is to be transferred from the coil-transporting carriage 1. Once again, the control unit 16 is designed to carry out the sequence automatically, by the corresponding facilities of the coil-transporting carriage—as described above the first and second drive unit 3 and 13 and the rotary drives 9—being activated by the control unit 16 in the steps S11 to S16 and S19 (in FIG. 8 once again symbolized by dashed arrows to the aforementioned facilities).

In the second step S12, it is reported to the control unit 16 that the sleeve 21 has been deposited by means of the delivery device 32, which again can take place for example by transmitting a corresponding confirmation signal via the external control unit 19 and the interface 17. While the sleeve 21 is being deposited, further signals (for example current position signals of the delivery device 32) for the above-described synchronization of the movement of the coil saddle 5 and the delivery device 32 can be reported to the control unit 16. In the seventh step S17, it is reported to the control unit 16 that the coiler mandrel 22 has been spread apart, which means that from this point in time the sleeve 21 is held in a force-locking manner by the coiler mandrel 22, whereupon the control unit 16 proceeds to the final step S18.

LIST OF REFERENCE NUMERALS

1 Coil-transporting carriage
2 Metal strip

3 First drive unit
4 Chassis
5 Coil saddle
7 Bearing roller
8 Rails
9 Rotary drive
11 Retaining arm
11' Inner face
12 Wheel
13 Second drive unit
14 Coating
15 Slide roller
16 Control unit
17 Interface
19 Higher-level control unit
20 Coil, residual coil
20' Strip portion
20" Free strip end
21 Sleeve
22 Coiler mandrel
23 Drive rollers
24 Cutting device
30 Delivery station
31 Base
32 Delivery device, pivoting device
34 Support arm
35 Crossmember
36 Roller conveyor
37 Pivoting drive
38 Longitudinal member
$\alpha_{max}$ Angular range
a Dimension of coil, sleeve
$d_{max}$ Maximum extent
$d_0$ Limit diameter
$d_{btw}$ Dimension of coil-transporting carriage
g Coil weight
$h_0$ Transfer height
$h_1$ Initial height
m State of coiler mandrel
M Longitudinal axis
P Park position
S Securing position
A Receiving position
S1 . . . S18 Method step
U Unwinding direction
$X_1$, $X_2$ Horizontal direction
Z Target position

The invention claimed is:

1. A coil-transporting carriage for handling one of a coil and a sleeve on a coiler mandrel, comprising:

a coil saddle vertically displaceable by a first drive unit and having a plurality of bearing rollers, each of the plurality of bearing rollers being axially rotatable about a first horizontal direction for receiving the one of the coil and the sleeve;

retaining arms pivotable about the first horizontal direction by rotary drives for stabilizing the one of the coil and the sleeve, the coil being stabilized when an external diameter of the coil is not greater than a limit diameter, the retaining arms being arranged in pairs in a second horizontal direction oriented perpendicularly to the first horizontal direction and opposing one another on the coil saddle;

a second drive unit for horizontally displacing the coil-transporting carriage;

a control unit for actuating the first drive unit, the second drive unit, and the rotary drives; and a data interface for communication with a higher-level control unit.

2. The coil-transporting carriage as claimed in claim 1, wherein the rotary drives are geared motors.

3. The coil-transporting carriage as claimed in claim 1, wherein:

the retaining arms are configured to be pivoted into a park position;

the retaining arms in the parked position having a greatest extent between the retaining arms in the second horizontal direction; and the greatest extent being smaller than or equal to a greatest dimension of the coil-transporting carriage in the second horizontal direction.

4. The coil-transporting carriage as claimed in claim 1, wherein the retaining arms stabilize the one of the coil and the sleeve having an external diameter of between 500 mm and the limit diameter in a form-locking manner.

5. The coil-transporting carriage as claimed in claim 1, wherein inner faces of the retaining arms have one of a friction-reducing coating and slide rollers.

6. A method for pulling off a coil from a coiler mandrel by the coil-transporting carriage as claimed in claim 1, the coil having an external diameter smaller than a limit diameter, comprising:

in a first step, displacing the coil saddle vertically by the first drive unit and adjusting against the coil located on the coiler mandrel and connected to an uncoiled strip portion so that the bearing rollers of the coil saddle come into contact with the coil on a peripheral side on a lower face of the coil;

in a second step, pivoting the retaining arms onto the coil by the rotary drives;

in a third step, cutting off the uncoiled strip portion from the coil by a cutting device;

in a fourth step, rotating the coil by the coiler mandrel counter to an unwinding direction of the coil until the free strip end of the coil is positioned on the peripheral side within a predetermined angular range relative to a vertical through a longitudinal axis of the coil, and subsequently the coiler mandrel is collapsed;

in a fifth step, moving the coil-transporting carriage by the second drive unit away from the coiler mandrel until the coil is fully pulled off from the coiler mandrel, wherein at a same time the coiler mandrel is rotated counter to the unwinding direction; and in a sixth step, transporting, by activating the second drive unit, the coil by the coil-transporting carriage to a target position.

7. The method as claimed in claim 6, wherein the target position is a binding station.

8. The method as claimed in claim 6, wherein, in a step between the fifth and the sixth step, the coil saddle is lowered vertically by the first drive unit.

9. The method as claimed in claim 6, wherein:

the control unit receives data via the data interface from a higher-level control unit; and the control unit actuates the first drive unit, the second drive unit, and the rotary drives based on the data to perform the method.

10. The method as claimed in claim 9, wherein the data comprise at least one of a state of the coiler mandrel, dimensions of the coil on the coiler mandrel, a coil weight, and a target position.

11. A method for pushing a sleeve onto a coiler mandrel by the coil-transporting carriage as claimed in claim 1, comprising:

in a first step, displacing the coil-transporting carriage by the second drive unit to a receiving position in front of a delivery station, the coil saddle being displaced by the first drive unit into a transfer height and the retaining arms being pivoted by the rotary drives into a securing position;

in a second step, depositing the sleeve by a delivery device of the delivery station onto the coil saddle of the coil-transporting carriage;

in a third step, pivoting the retaining arms by the rotary drives onto the sleeve, inner faces of the retaining arms coming into contact with the sleeve on a peripheral side;

in a fourth step, displacing the coil-transporting carriage by the second drive unit to a position directly in front of the coiler mandrel;

in a fifth step, displacing the coil saddle vertically by the first drive unit so that a longitudinal axis of the sleeve is located level with the coiler mandrel;

in a sixth step, moving the coil-transporting carriage by the second drive unit toward the coiler mandrel until the sleeve is pushed fully onto the coiler mandrel;

in a seventh step, expanding the coiler mandrel so that the sleeve is held in a force-locking manner by the coiler mandrel; and in an eighth step, pivoting the retaining arms away from the sleeve by the rotary drives, the coil saddle being lowered vertically by the first drive unit.

12. The method as claimed in claim 11, wherein during the second step the coil saddle is displaced by the first drive unit in the vertical direction so that the coil-transporting carriage does not collide with any part of the delivery device.

13. The method as claimed in claim 11, wherein:

the control unit receives data via the data interface from the higher-level control unit; and the control unit actuates the first drive unit, the second drive unit, and the rotary drives based on the data to perform the method.

14. The method as claimed in claim 13, wherein the data comprise dimensions of one of the sleeve, a state of the coiler mandrel, and a receiving position.

* * * * *